US006599113B1

(12) United States Patent
Lee

(10) Patent No.: US 6,599,113 B1
(45) Date of Patent: Jul. 29, 2003

(54) INDEPENDENT VANE ROTARY GAS COMPRESSOR

(76) Inventor: Charles Matthew Lee, 837 Spence Cir., Virginia Beach, VA (US) 23462

( * ) Notice: Subject to any disclaimer, the term of this patent is extended or adjusted under 35 U.S.C. 154(b) by 0 days.

(21) Appl. No.: 10/060,673

(22) Filed: Feb. 1, 2002

(51) Int. Cl.[7] ..... F03C 2/00
(52) U.S. Cl. ..... 418/256; 418/135; 418/147
(58) Field of Search ..... 418/256, 135, 418/147

(56) References Cited

U.S. PATENT DOCUMENTS

| | | | | | |
|---|---|---|---|---|---|
| 935,343 | A | * | 9/1909 | Westinghouse | 418/256 |
| 2,414,187 | A | * | 1/1947 | Borsting | 418/256 |
| 3,360,192 | A | * | 12/1967 | Van Hees | 418/256 |
| 3,955,540 | A | * | 5/1976 | Blanchard | 418/256 |
| 6,024,549 | A | * | 2/2000 | Lee | 418/135 |
| 6,349,695 | B1 | * | 2/2002 | Lee | 123/227 |

* cited by examiner

*Primary Examiner*—Thomas Denion
*Assistant Examiner*—Theresa Trieu

(57) ABSTRACT

A radial vane type machine intended for production of compressed gaseous and vaporous fluids with industrial scale measures of compression amplification and throughput. Fluid compression is accomplished by mechanical volume manipulation but without the use of reciprocating pistons and/or intermittently operating mechanical valves. The machine incorporates features for thermal control necessary for high performance single stage pressure amplification, and features for minimization of mechanical friction necessary to ensure functional viability. The physical and input power characteristics of the machine are compatible with the physical and output power characteristics of modern, commercially available internal combustion and electrical power sources. Compared with reciprocating piston type fluid compressors the machine potentially offers substantial measures of excellence in terms of vibration-free operation, functional efficiency, reliability, and power density relative to both space and weight criteria.

1 Claim, 16 Drawing Sheets

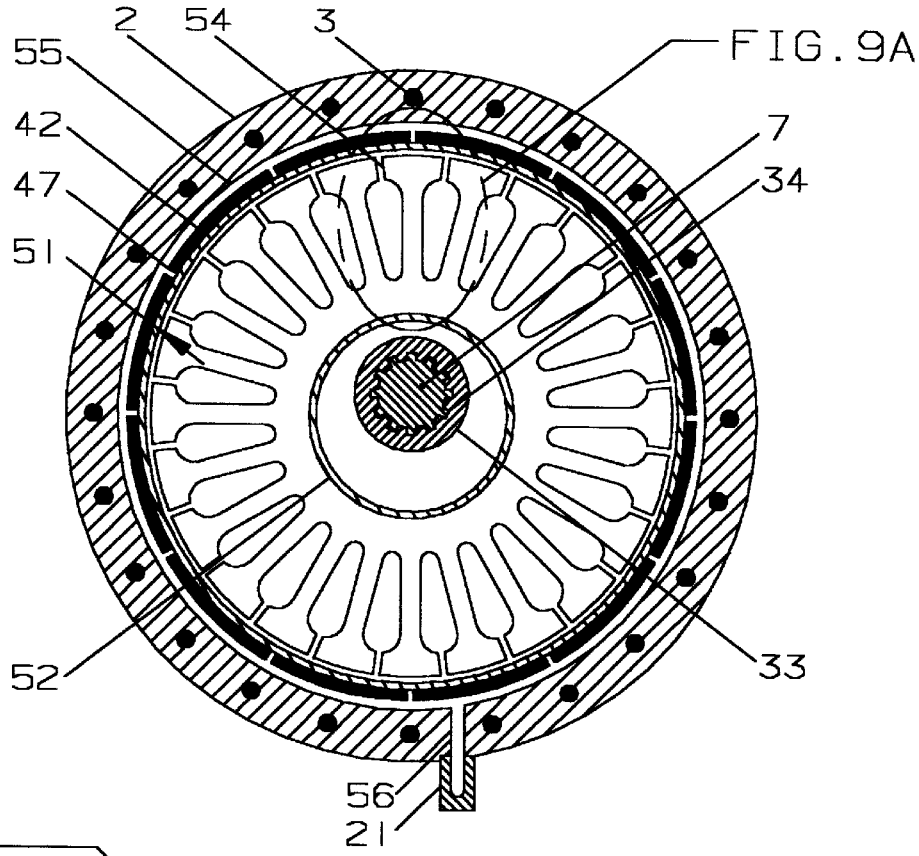
FIG. 9A
FIG. 9
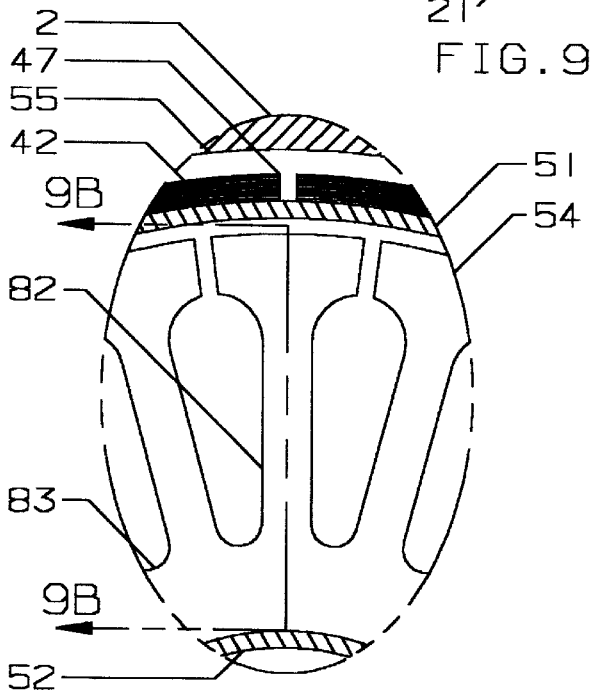
FIG. 9A
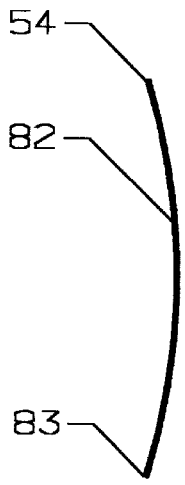
FIG. 9B

INDEPENDENT VANE ROTARY GAS COMPRESSOR

CROSS REFERENCE TO RELATED APPLICATIONS

Not applicable

STATEMENT REGARDING FEDERALLY FUNDED RESEARCH OR DEVELOPMENT

No products of Federally Funded Research or Development are reflected in, or referenced in, this disclosure.

REFERENCE TO A MICROFICHE APPENDIX

No Microfiche Appendix is included in this application.

BACKGROUND OF THE INVENTION

This disclosure presents an independent vane type rotary machine for pressurization of gaseous and vaporous fluids at measures of pressure amplification and throughput commonly related to industrial scale fluid pressurization service. For the purposes of this disclosure "industrial scale fluid pressurization service" is defined as gas/vapor manipulation involving a pressure amplification ratio in excess of five and input power in excess of two kilowatts.

At the present time compressors used for industrial scale compression of gaseous or vaporous fluids are either reciprocating piston machines or multiple stage turbo machines. Reciprocating piston compressors amplify fluid pressure through direct mechanical manipulation of volume by means of reciprocating motion of a piston within a closed cylinder. Mechanically actuated valves control induction and discharge of throughput fluid. Reciprocating piston compressors offer good measures of efficiency and operational flexibility but reciprocating motion of dynamically significant components creates an inherent source of undesirable mechanical noise and vibration. Turbo type compressors accomplish pressure amplification through dynamic interaction of throughput fluid with purely rotational mechanical components and function without mechanically activated throughput induction and discharge valves. In comparison with reciprocating piston compressors, turbo type compressors are substantially free from mechanical noise and vibration but offer economic superiority only in applications requiring relatively large measures of continuously sustained input power.

Over a number of years significant inventive effort has been directed toward the derivation of a rotary type fluid manipulation machine offering operational flexibility as given by reciprocating machines but without incurring the use of reciprocating components. Radial vane type rotary machines have been the focus of particular attention in this regard. Radial vane rotary compressors ideally feature pressure amplification by volume manipulation without the use of reciprocating mechanical components and potentially offer good measures of power density, functional efficiency, and mechanical reliability. Radial vane rotary machines have been commonly developed to function as relatively small fluid pumps and small fluid driven motors but, as of the time of this disclosure, no radial vane type rotary machine is known to function as a gas/vapor compressor with industrial scale measures of pressure amplification and throughput.

In general, radial vane rotary machines primarily consist of a stationary containment structure and an internal rotational assembly. The stationary containment structure primarily consists of a containment cylinder installed with a mechanically secured closure structure at each axial end and with ports for induction and discharge of throughput fluid. Although particular design features may vary, the internal rotational assembly essentially consists of a rotational shaft, a rotational armature, and a plurality of radially oriented vanes. The rotational shaft extends through and is radially constrained by rotational bearings in one or both end closure structures and mechanically interfaces with an external power source. The rotational shaft is aligned with its rotational axis parallel to the axis of the containment cylinder bore. The rotational armature is concentrically secured on the rotational shaft and is diametrically proportioned to create an annular void between its periphery and the containment cylinder bore. The radially oriented vanes are individually installed and radially slide within radial vane slots equidistantly spaced around the periphery of the rotational armature. Each radially oriented vane axially extends through the axial length of the rotational armature and radially extends from within the radial vane slot to contact, or closely approach, the containment cylinder bore. The radial vanes collectively subdivide the aforesaid annular void into a plurality of segmental cells. Each axial end of each segmental cell is closed by and axial end closure ring or the inside surface of an end closure structure. Through geometric separation of the axis of the rotational armature from the axis of the containment cylinder bore, or through shaping of the containment cylinder bore, the relative volume of each segmental cell is dependent upon the rotational position of the rotational armature. Rotation of the rotational armature causes cyclical manipulation of segmental cell volume in a manner functionally analogous to the volume manipulation accomplished by piston movement in a reciprocating piston machine. For given proportions of containment cylinder bore, the magnitude of manipulated volume is inversely influenced by the diameter of the rotational armature and the plurality and thickness of the radial vanes. The extent of volume manipulation is directly influenced by the plurality of radial vanes, the magnitude of radial separation of the axes of the rotational shaft and the containment cylinder bore axis and/or by the shaping of the containment cylinder bore. The extent of volume manipulation may also be influenced by the sector width and sector location of ports allocated for induction and discharge of throughput fluid.

Rotary vane machines may feature either "trans-axial blade" or "independent vane" type radial vane arrangements. In the trans-axial blade type vane arrangement each radial vane slot extends through the axial length and diameter of the rotational armature. Each radial vane slot accommodates a sliding blade proportioned to closely approach the diameter of the containment cylinder bore and thus create two radial vanes. As trans-axial blades intersect the rotational armature axis a plurality of radial vanes in excess of two requires interlacing of the trans-axial blades. Interlacing impairs the radial strength of the trans-axial blades and thereby imposes a constraint on radial vane plurality. Interlacing of four trans-axial blades to provide eight radial vanes is about the practical in limit obtainable within the constraints of commonly available materials and acceptable rotational speeds. Analysis demonstrates that rotary vane machines with eight radial vanes do not provide the measure of single-stage pressure amplification appropriate for industrial-scale gas/vapor compressor service. Single-stage pressure amplification may be enhanced by incorporation of mechanically actuated fluid control valves but such measure necessarily incurs increased mechanical complexity and reduced functional efficiency. For these reasons trans-axial blade type rotary vane machines are precluded from further discussion.

In the independent vane arrangement each radial vane functions as an independent entity and so this arrangement precludes the requirement for blade interlacing and its constraint on blade plurality. Because of this feature independent vane type rotary vane machines offer an approach to achieving relatively high measures of single-stage pressure amplification without mechanically actuated throughput control valves. Independent vane type rotary machines have been substantially addressed in prior art and technology presented in prior art may be deemed adequate for engineering of liquid pumps and relatively small gaseous fluid manipulation devices. However physical laws related to similitude, mechanical fiction and adiabatic compression render much of the technology addressed in prior art inapplicable for engineering of gaseous fluid compression machines intended to provide industrial scale service. The influences of physical laws on the principal functional requirements of rotary vane machine technology as presented in prior art are briefly reviewed in the following paragraphs.

As previously noted independent vane type rotary machine require each radial vane to be individually radially constrained to resist centripetal force induced by rotation of the armature. In U.S. Pat. No. 3,447,477, U.S. Pat. No. 3,973,881, and U.S. Pat. No. 4,772,190 radial constraint of radial vanes is accomplished by simply allowing the radial vanes to make sliding contact with the containment cylinder bore. In U.S. Pat. No. 985,091 radial vanes are collectively constrained by a pair of rotating rings partially embedded in the bore of the containment cylinder and in U.S. Pat. No. 2,590,132 radial vanes are individually constrained by engagement of a cylindrical axial protrusion with an axially constrained but freely rotating component installed at each end. Later disclosures present approaches for radially constraining radial vanes by means of roller and cam devices. U.S. Pat. No. 5,087,183 and U.S. Pat. No. 5,452,998 each feature an approach in which each radial vane is fitted with an axially aligned cylindrical protrusion and tether component installed close to its radially innermost axial edge at each axial end which is radially constrained by a rotational bearing embedded in the adjacent end enclosure structure. All radial constraint concepts noted above incur comparatively large measures of relative motion at interfacing load-bearing surfaces and, hence, substantial dissipation of input energy through mechanical friction. For geometrically similar machines the fraction of input energy dissipated by mechanical friction proportionally increases as a function of scale, rotational velocity and pressure amplification. In view of these considerations the technical approaches to radial vane constraint presented in the prior art noted above although functionally viable for small pumps and small gaseous fluid compression machines are deemed to incur such measures of mechanical friction as to be functionally non-viable for geometrically similar machines featuring the physical characteristics appropriate for industrial service. U.S. Pat. No. 2,414,187, U.S. Pat. No. 3,360,192, U.S. Pat. No. 6,024,549, and Japan Patent No. 63-9685 all feature an approach in which the radial vanes are collectively constrained by an axially extended flange on the periphery of a freely rotating disk or ring component at each axial end. In comparison with other prior art the technique of radial vane constraint presented in these latter disclosures significantly reduces the linear extent of relative motion at interfacing load-bearing surfaces and consequentially diminishes the fraction of input energy dissipated by mechanical friction.

Independent vane type rotary machines require each radial vane to incur reciprocating sliding motion relative to the rotational armature and, hence, dissipation of input energy through frictional interaction at the dynamic interface. As both sides of the radial vane must be constrained the consequence of thermal expansion in the thickness of the radial vane is a viability consideration. Additionally the reciprocating motion of the radial vane within the radial vane slot requires the base of each radial vane slot to be adequately vented in order to preclude radial vane seizure through hydraulic lock. The approach to radial constraint of radial vanes presented in prior art simply features sliding contact between the sides of the radial vane and the sides of the radial vane slot and prior art is silent regarding accommodation of thermal expansion and need for minimizing energy dissipation due to friction at the sliding surfaces. Also approaches to radial vane installation presented in prior art ignore the specific requirement for radial vane slot venting or imply that hydraulic lock at the radial vane base is precluded by ancillary pumping through lubrication ports in the rotating armature. U.S. Pat. No. 6,024,549 features a rotating armature configured as a hollow structural annulus and radial vane slots that penetrate the full thickness of the annulus wall. The approach to radial vane constraint as presented in this latter disclosure thus precludes energy dissipation through radial vane slot base pumping however the disclosure is silent regarding thermal expansion and friction reduction considerations. For geometrically similar machines the extent of thermal expansion is proportionally related to scale and component temperature. The fraction of input energy dissipated by frictional interaction and ancillary pumping within the radial vane slot are proportionally related to scale, pressure amplification, and rotational velocity. Because of such scaling relationships the functional characteristics of the means of radial vane constraint become increasingly significant from a functional viability viewpoint as machines increase in size. For these reasons the approaches to radial vane constraint as presented in prior art although adequate for small-scale fluid movement machines are deemed inadequate for rotary vane fluid compression machines featuring the physical characteristics appropriate for industrial service.

Radial vane rotary machines require the segmental cells to be effectively closed at each axial end. U.S. Pat. No. 5,087,183 and U.S. Pat. No. 5,452,998 feature closure of the axial ends of segmental cells by closely fitting the axial interfaces between rotational components and end closure structures. U.S. Pat. No. 985,091 features installation of a non-rotating sealing disk at one axial end of the rotational armature which may be axially adjusted to minimize or eliminate the distance of separation at the axial interfaces between rotational components and stationary structures. U.S. Pat. No. 2,414,187, U.S. Pat. No. 3,360,192, and Japan Pat. No. 63-9685 each feature installation of an axially constrained but freely rotating sealing ring at each axial end of the rotational armature. U.S. Pat. No. 2,590,132 features an approach by which each radial vane slot is axially closed by an axially constrained but freely rotating disk installed at one axial end of the rotational armature and an axially constrained but freely rotating ring at the other. None of the approaches noted above provide the axial resiliency to accommodate axial thermal expansion of rotational components and are therefore deemed non-viable for industrial scale gas compression machines in which significant frictional and adiabatic heating and consequential thermal expansion may be expected. U.S. Pat. No. 3,447,477, U.S. Pat. No. 3,973,881, and U.S. Pat. No. 4,772,190 each feature an approach in which the axial ends of radial vane slots are closed by axially constraining the rotating armature and the radial vanes between a non-rotating wear plate at one axial end and a non-rotating axially resilient cheek-plate at the other. Axial resiliency of the cheek plate is maintained by an axial compression spring and pressurized throughput fluid. In this case axial resiliency of the cheek plate precludes thermal expansion concerns but the non-rotational mobility of the axially constraining components entails significant energy dissipation through a substantial measure of relative motion at their frictional interfaces with rotational components. As the fraction of input energy dissipated by frictional interaction at the axial interface is proportionally related to scale, rotational velocity, and pressure amplification it is believed that the application of this approach in industrial-scale gas compression machines would incur such energy dissipation as to be unacceptable from a mechanical efficiency viewpoint. U.S. Pat. No. 6,024,549 features installation of axially and rotationally mobile axial end closure components. The approach to axial closure presented in this disclosure provides the means to resiliently accommodate thermally induced dimensional adjustments in associated components and precludes significant energy dissipation through mechanical friction and in view of these attributes is considered to be appropriate for application in industrial-scale gas compression machines.

Machines compressing gaseous fluids are subject to component heating caused by both adiabatic effects of throughput fluid compression and friction at mechanically dynamic interfaces. The functional viability of a machine is dependent upon component temperatures being within thresholds prescribed by lubrication and/or structural constraints. The measure of heat energy produced by a gaseous fluid compression machine is directly related to its functional capability in terms of pressure amplification and throughput. For this reason commonly available industrial scale gaseous fluid compressors incorporate means of thermal control for both external and internal components and it is anticipated that similar thermal control is necessary for rotary vane gaseous fluid compression machines intended to demonstrate comparable performance capabilities. Rotary vane machine concepts presented in prior disclosures often address means of thermal control for stationary containment structures but substantially disregard thermal control for internal dynamic components and, hence, ignore a requirement essential for the functional viability of industrial-scale machines.

In summary it is concluded that the rotary vane machine technologies presented in prior art although possibly adequate for rotary vane type gaseous fluid compression machines featuring small measures of physical size, pressure amplification, and throughput but inadequately address several mechanical issues which, through scaling relationships, vitally influence the functional viability of machines intended for industrial service. The rotary machine presented in this disclosure illustrates primary geometric relationships and other technical features as developed to resolve viability issues discussed in prior paragraphs. The disclosure provides a technological foundation for creation of industrial-scale rotary vane gas/vapor compressors offering measures of functional efficiency and mechanical reliability equal or superior to the performance capabilities of comparable reciprocating compression machines presently available.

BRIEF SUMMARY OF THE INVENTION

This disclosure presents an independent vane type rotary vane machine for compression of gaseous or vaporous fluids at a power level appropriate for industrial scale service. The disclosure illustrates the geometric relationships and technical features necessary to achieve the measures of single stage pressure amplification, mechanical efficiency, and thermal control necessary to satisfy fundamental functional viability considerations.

The machine consists of a stationary containment structure and an internal rotational assembly. The stationary containment structure features a containment cylinder with a circular bore installed with a mechanically secured closure structure at each axial end and with ports for induction and discharge of throughput fluid. Each end closure structure accommodates bearings for support of the internal rotational assembly, a port for movement of internal thermal control media and a port for extraction of liquid condensate. Ports are also provided for supply and discharge of liquid lubricant to rotational bearings and for insertion of finely dispersed liquid lubricant for lubrication of internal interactively dynamic load bearing surfaces.

The internal rotational assembly primarily features a rotational shaft, a rotational armature, radial vanes, and a radial vane constraint assembly. The rotational shaft axially extends through the containment structure to mechanically interface with an external power source and its rotational axis is parallel to, but radially displaced from, the axis of the containment cylinder bore. The rotational armature is configured as a hollow structural annulus internally contoured to promote heat transfer to internal thermal control media and installed with an integral structural diaphragm at each axial end. Each structural diaphragm is concentrically secured on the rotational shaft and is penetrated by axially aligned ports to permit axial movement of internal thermal control media and with axially aligned ports to permit discharge of condensate liquid. The rotational armature accommodates a radial vane slot at each of twelve centers uniformly spaced around its circumference. Each radial vane slot extends through the radial thickness of the annulus to preclude the requirement for base venting and a linear bearing insert constructed from low-friction bearing material is installed on each side of the radial vane slot. Each pair of linear bearing inserts constrain one radial vane but permit the radial vane radial to slide freely on a radial plane and resiliently accommodate functionally induced deformation of the radial vane and the rotational armature. Each radial vane is proportioned to radially protrude a small distance within the annulus cavity to facilitate heat transfer from the radial vane to internal thermal control media and is installed with a bearing block at each radially outermost axial end. A freely rotating radial vane constraint assembly installed at each axial end of the rotational armature constrains the radial vane bearing blocks and their associated radial vanes against the centripetal force induced by rotational motion. Each radial vane constraint assembly is installed on low-friction rotational bearings to substantially preclude mechanical friction at the interfaces between major rotational components and stationary containment structure. Each radial vane constraint assembly includes an axial seal ring component constructed from graphite, high-temperature ceramic or similar low-friction and wear resistant bearing material. Each axial seal ring is proportioned to concurrently close all radial vane slots at one axial end. Each radial vane constraint assembly includes an axial compression spring that constrains the axial seal ring to maintain pressurized contact with one axial end of the rotational armature and one axial end of all radial vanes and resiliently accommodate function induced axial deformations in these components. Each radial vane constraint assembly is configured to maintain a distance of separation between the outermost radial edge of each radial vane and the containment cylinder bore and relatively lightweight vane edge seal is installed on the each radial vane to bridge the distance of separation. The vane edge seal is radially constrained by its associated radial vane and constructed from spring quality steel or similar resilient material. The vane edge seal is bifurcated along its radially outermost axial edge with the bifurcation edges proportioned to resiliently accommodate function induced diametrical deformation of its interfacing components.

Machine geometry inherently causes relative motions at dynamically interactive sliding interfaces to be sufficiently constrained that, for many applications, these interfaces may be derived to feature self-lubricating materials to minimize the risk of contamination of throughput fluid. However, for many applications, lubrication of internal sliding surfaces by liquid lubricant may be the preferred option and, for this reason, is included in this disclosure.

For purpose of presentation the device is illustrated with ancillary components as appropriate for induction and compression of atmospheric air. Adjustment of external ancillary components may be accomplished for the machine to be compatible with other gaseous fluids, gaseous fluid sources, or for the machine to function as a high vacuum pump. Also for purpose presentation the containment cylinder is illustrated with an arrangement of external ancillary fins for external thermal control and internal thermal control is accomplished by expansion of a portion of compressed throughput fluid. However, the use of liquid for external thermal control and the use of other media for internal thermal control are deemed equally acceptable and may be preferable choices in certain applications. Adjustments of external ancillary components are considered to be within the scope of the invention

BRIEF DESCRIPTION OF THE VARIOUS VIEWS OF THE DRAWING

Figure 4:
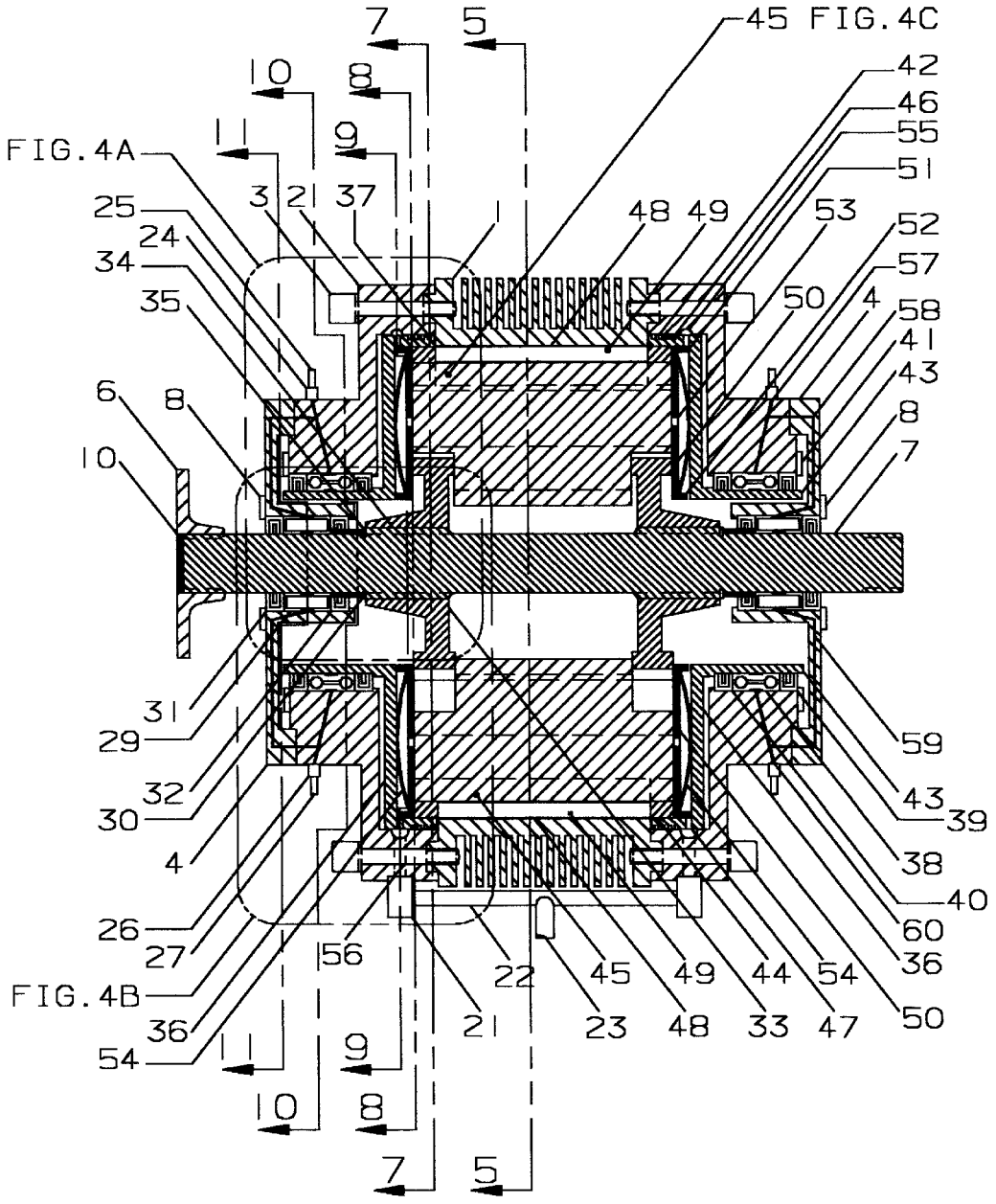

FIG. 4 is an axial section in the plane of the rotational axis and illustrates the axial disposition of significant internal components. FIG. 4 is supported by FIG. 4A, FIG. 4B, and FIG. 4C, FIG.4D and FIG. 4E that highlight significant mechanical details. Note that, with the exception of external interface components, the machine is geometrically symmetrical about the middle of the axial length and therefore many symmetrically duplicated features are numerically identified at one axial end only in order to avoid excessive nomenclature density. Cross section indicators given in FIG. 4 define axial locations of cross section illustrations later discussed.

Figure 5:
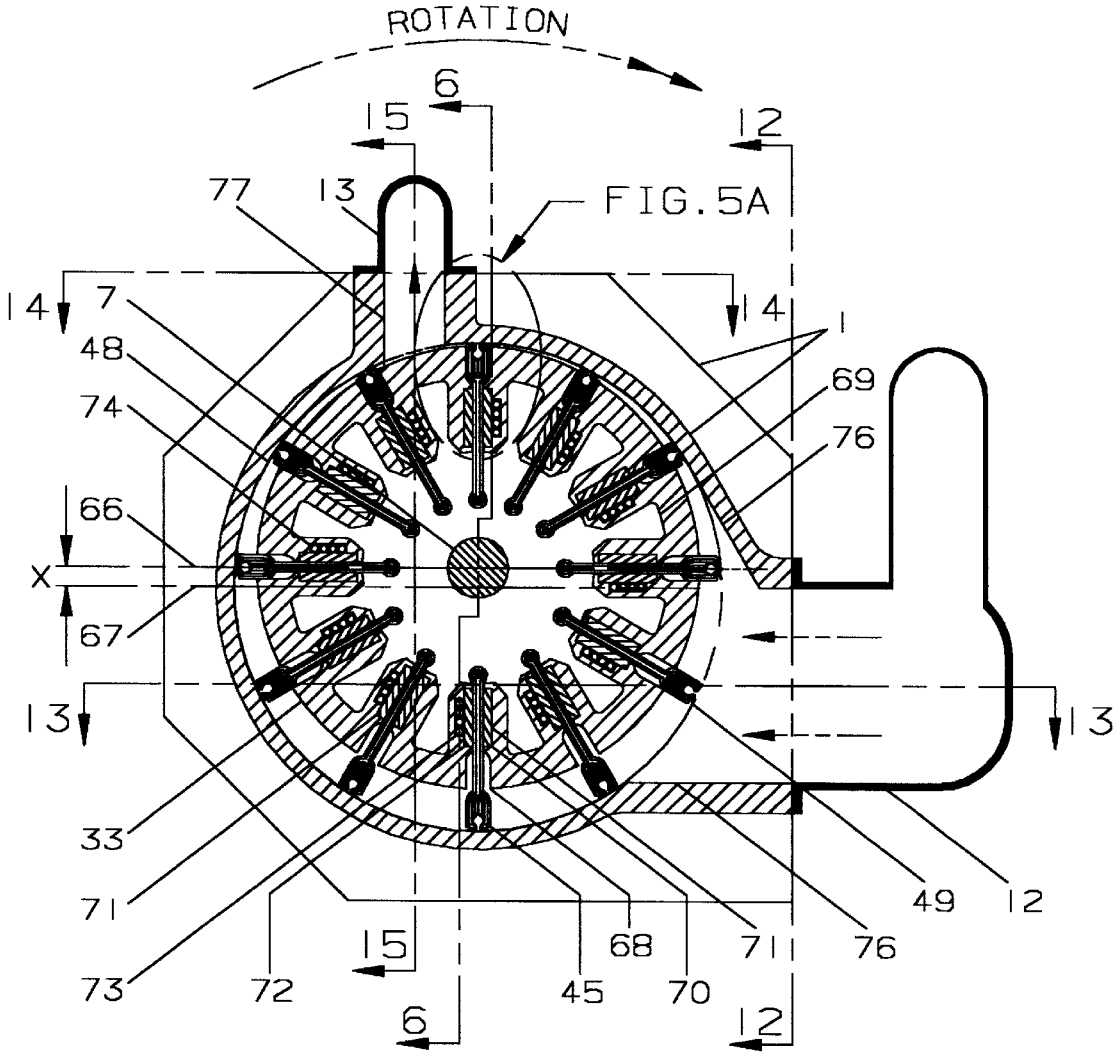

FIG. 5 is a cross section close to the middle of the axial length and illustrates the radial disposition of significant internal components. Section indicators given in FIG. 5 define locations of axial elevations and sections later discussed. FIG. 5 is supported by FIG. 5A, and FIG. 5B.

Figure 6:
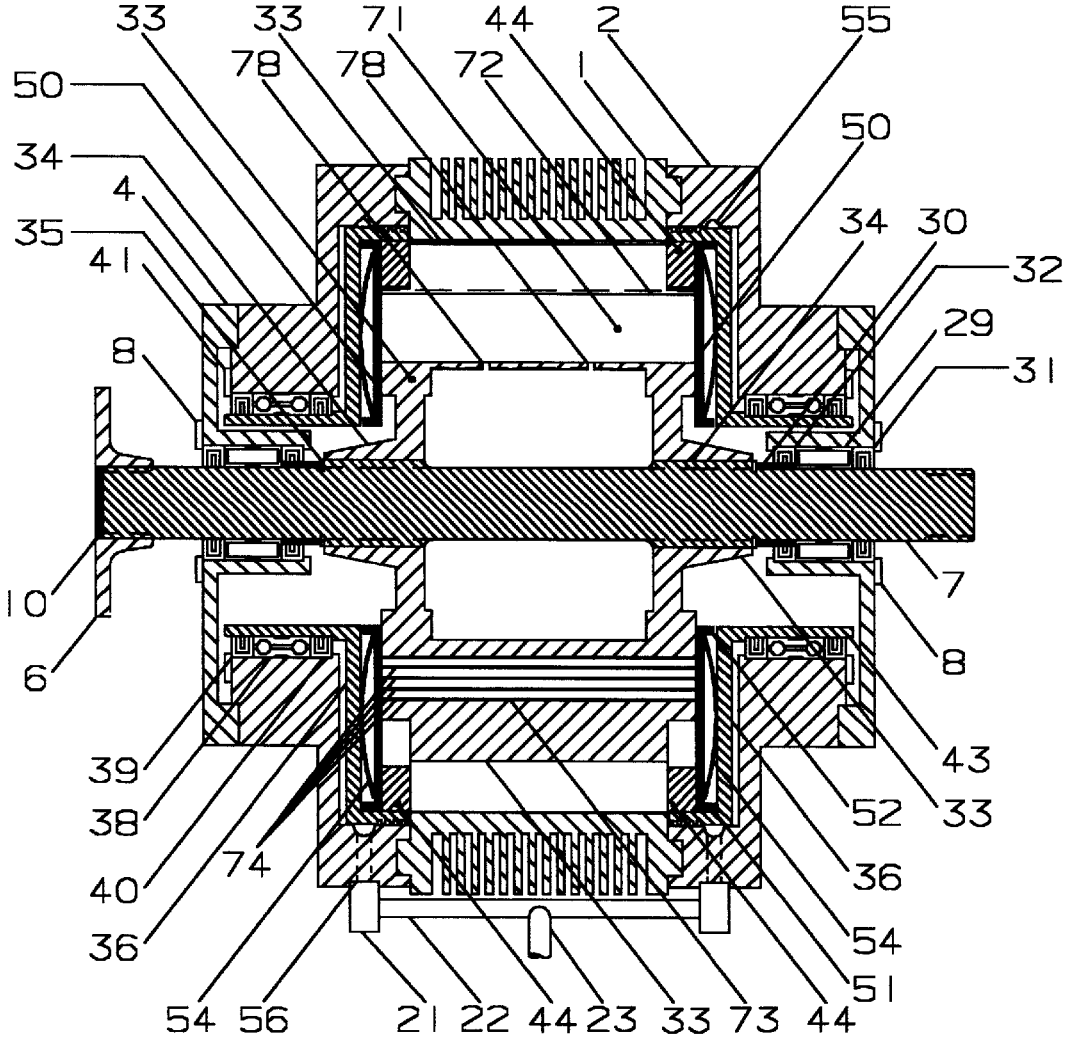

FIG. 6 is a compound axial section and illustrates the arrangement of radial vane constraint components installed within the structure of the rotational armature.

Figure 7:
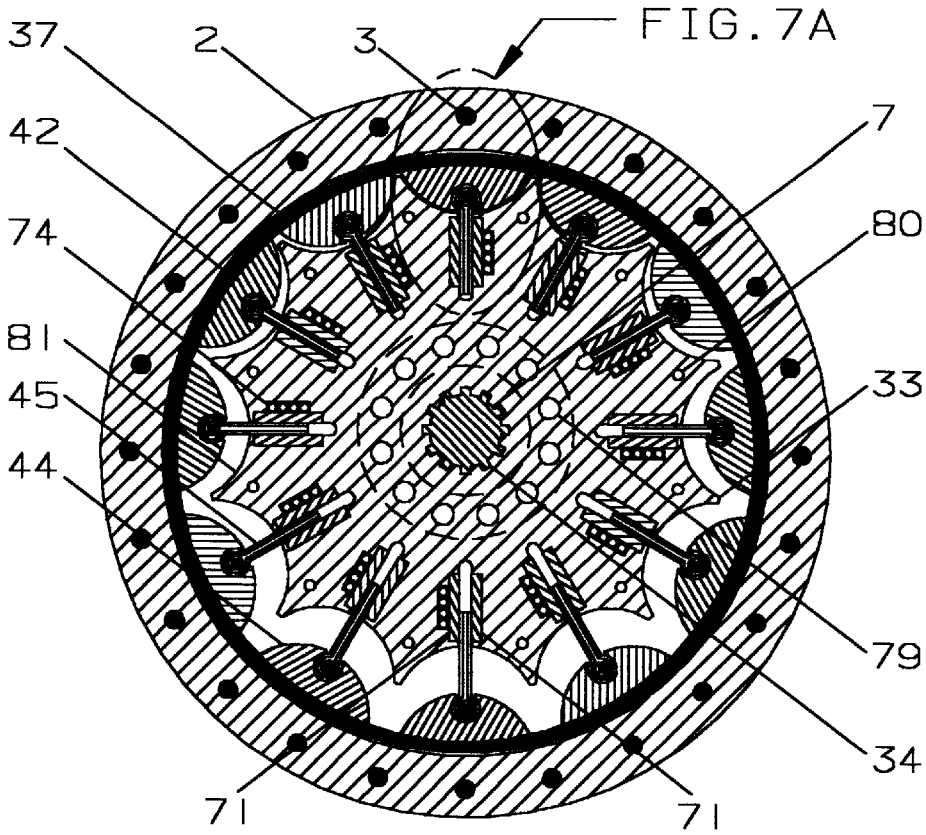

FIG. 7 is a cross section and illustrates the integration of rotational armature and rotational shaft, the radial features of vane end constraint components, and the arrangement of rotational armature end ports. FIG. 7 is supported by FIG. 7A.

Figure 8:
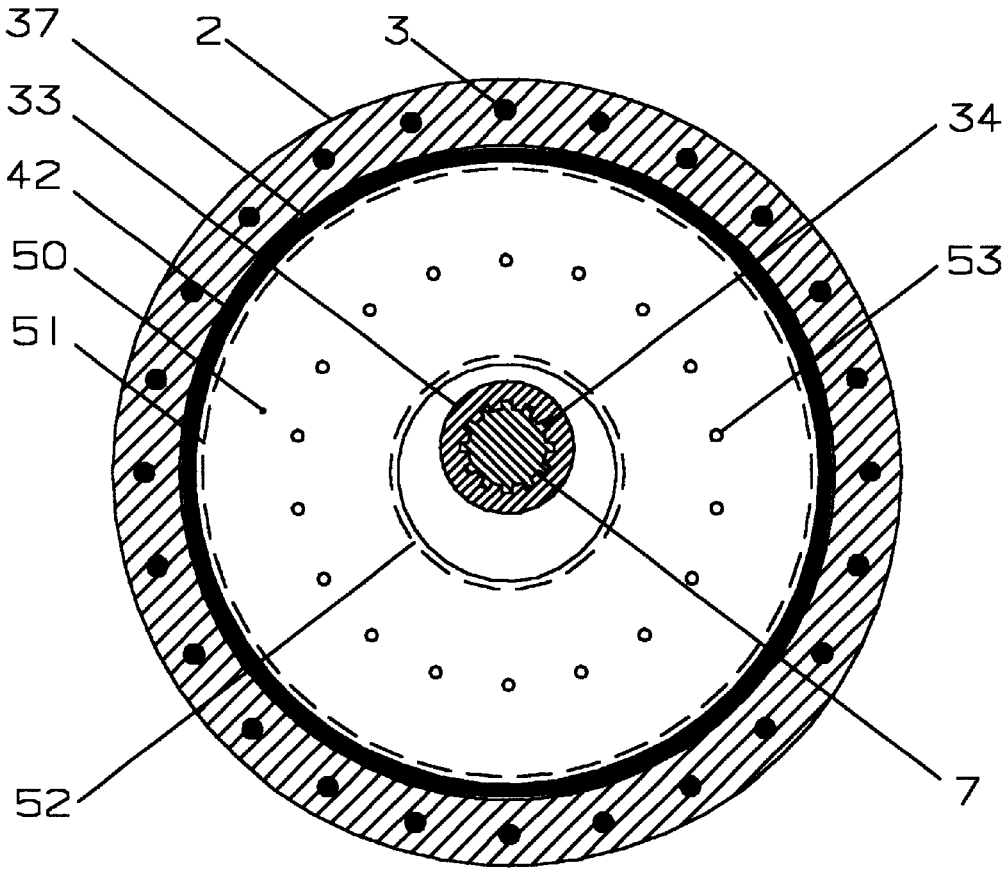

FIG. 8 is a cross section and, primarily, illustrates the arrangement and integration of radial vane constraint components.

FIG. 9 is an axially composite cross-section and, primarily, illustrates the integration and geometric features of one annular axial compression spring. FIG. 9 is supported by FIG. 9A and FIG. 9B.

Figure 10:
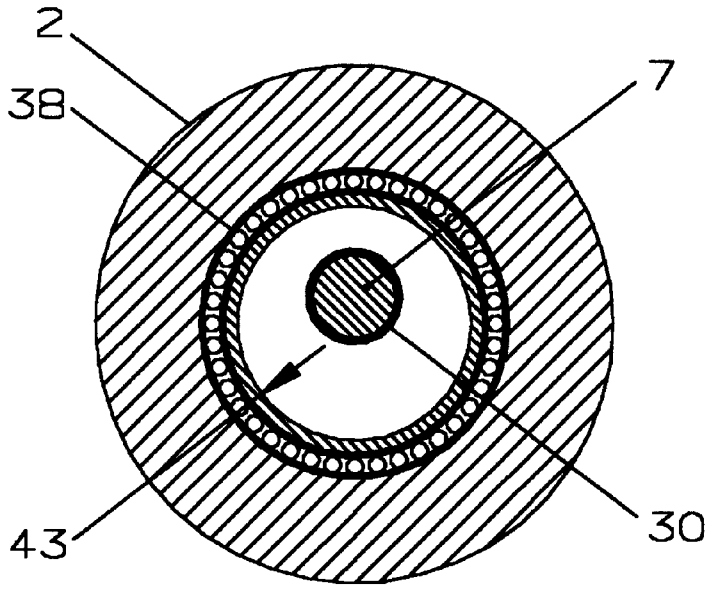

FIG. 10 is an axially composite cross-section and illustrates integration of one radial vane constraint ring rotational bearing within one stationary end closure structure.

Figure 11:
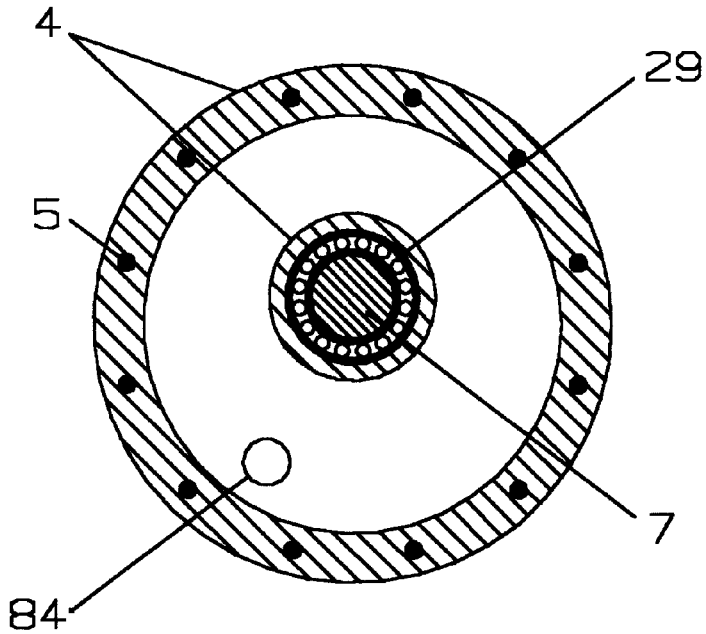

FIG. 11 is an axially composite cross-section and primarily illustrates integration of one rotational shaft support rotational bearing within one stationary bearing carrier.

Figure 12:
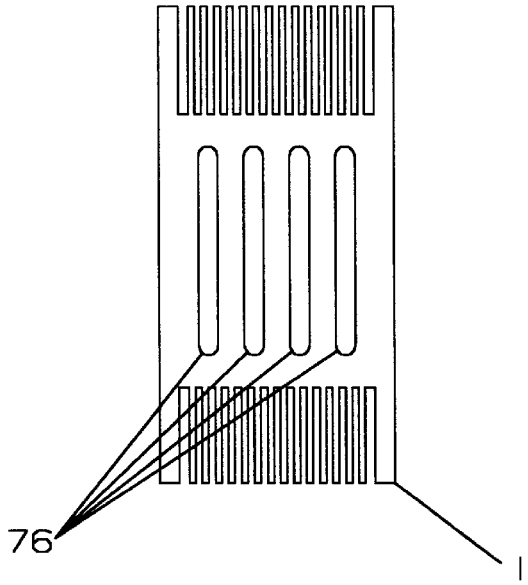
Figure 13:
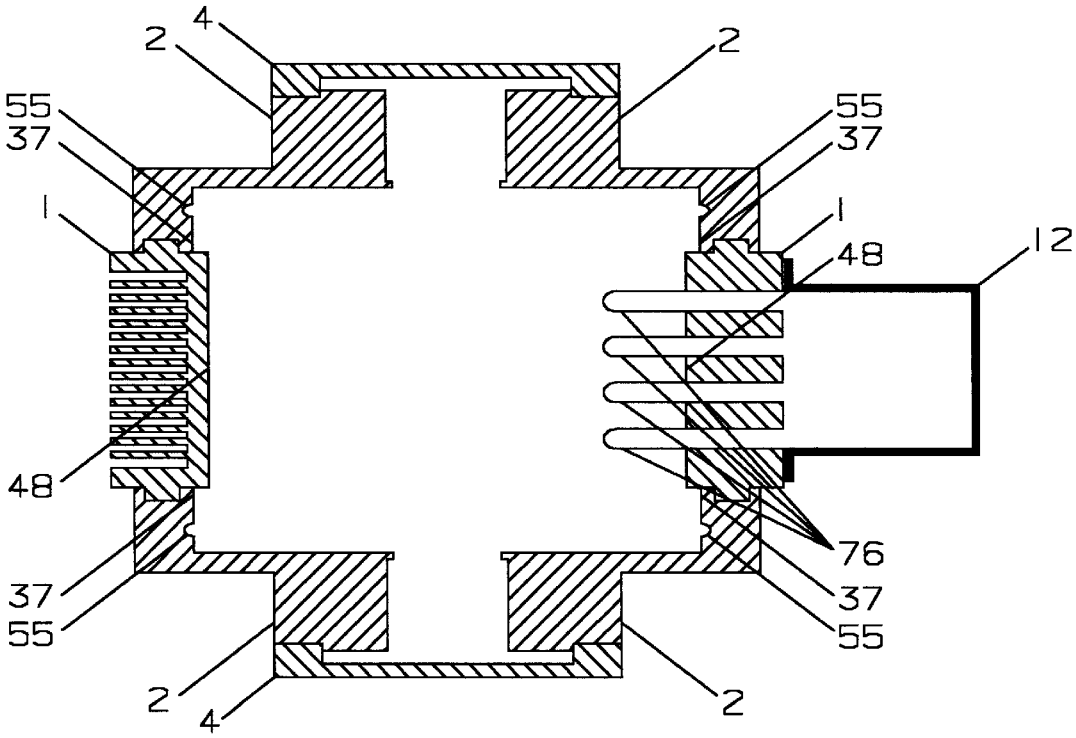

FIG. 12 and FIG. 13 illustrate the geometry and arrangement of throughput fluid induction ports relative to the throughput fluid induction manifold.

Figure 14:
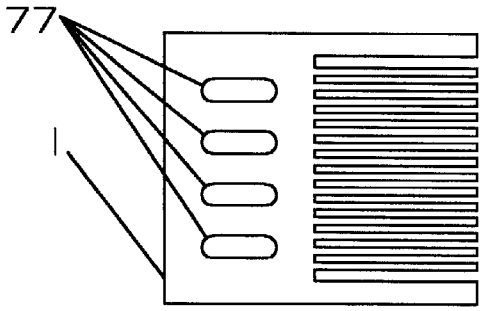
Figure 15:
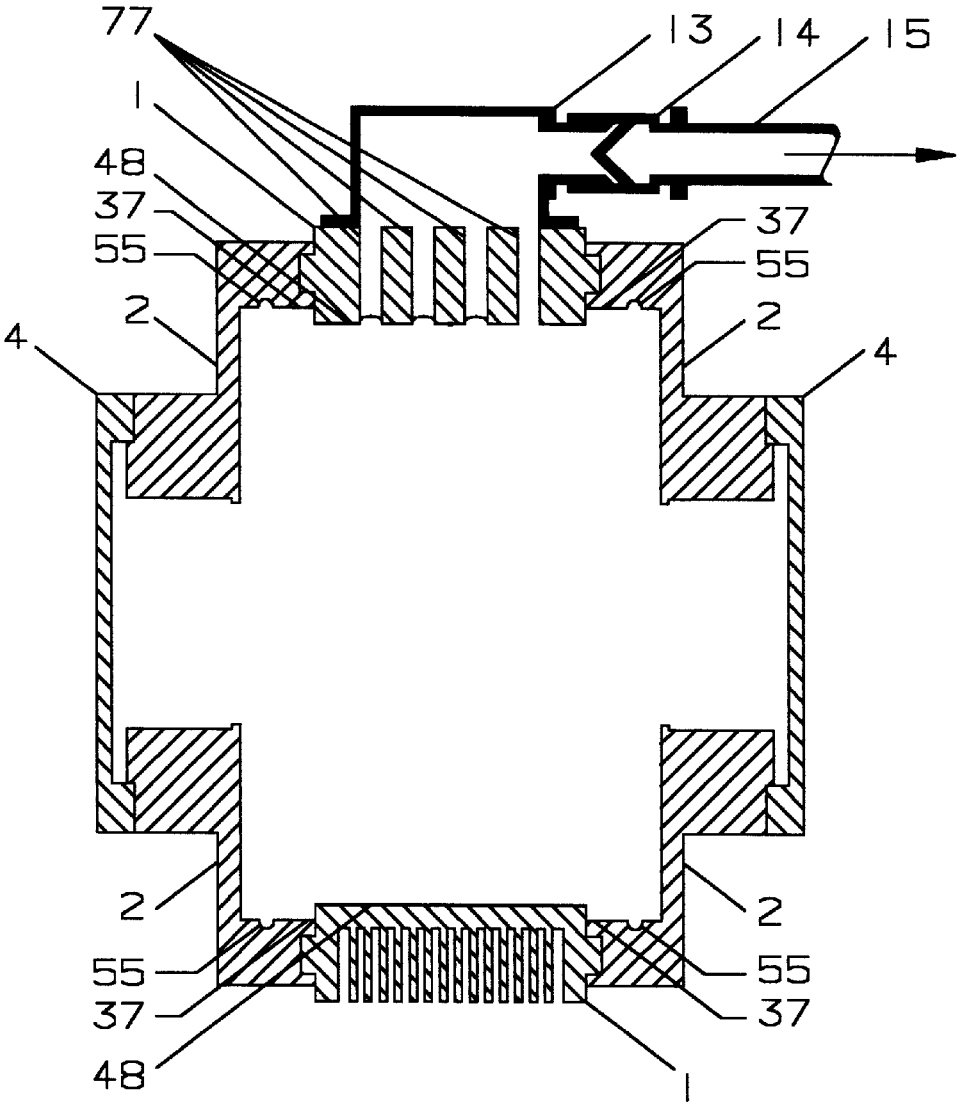

FIG. 14 and FIG. 15 illustrate the geometry and arrangement of throughput fluid discharge ports relative to the throughput fluid discharge manifold.

DETAILED DESCRIPTION OF THE INVENTION

Figure 1:
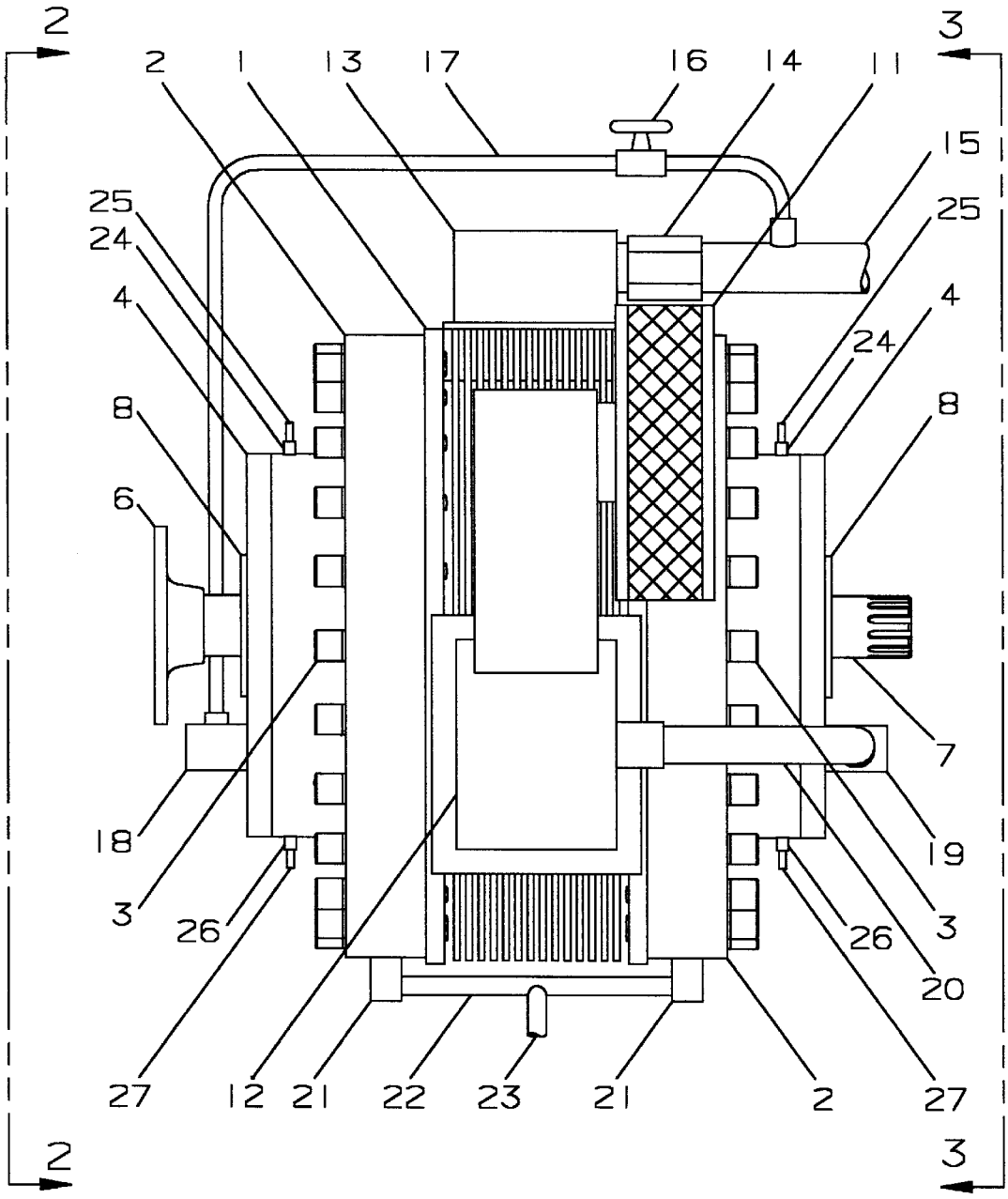
FIG. 1 is a side elevation and illustrates the axial disposition of external components.
Figure 2:
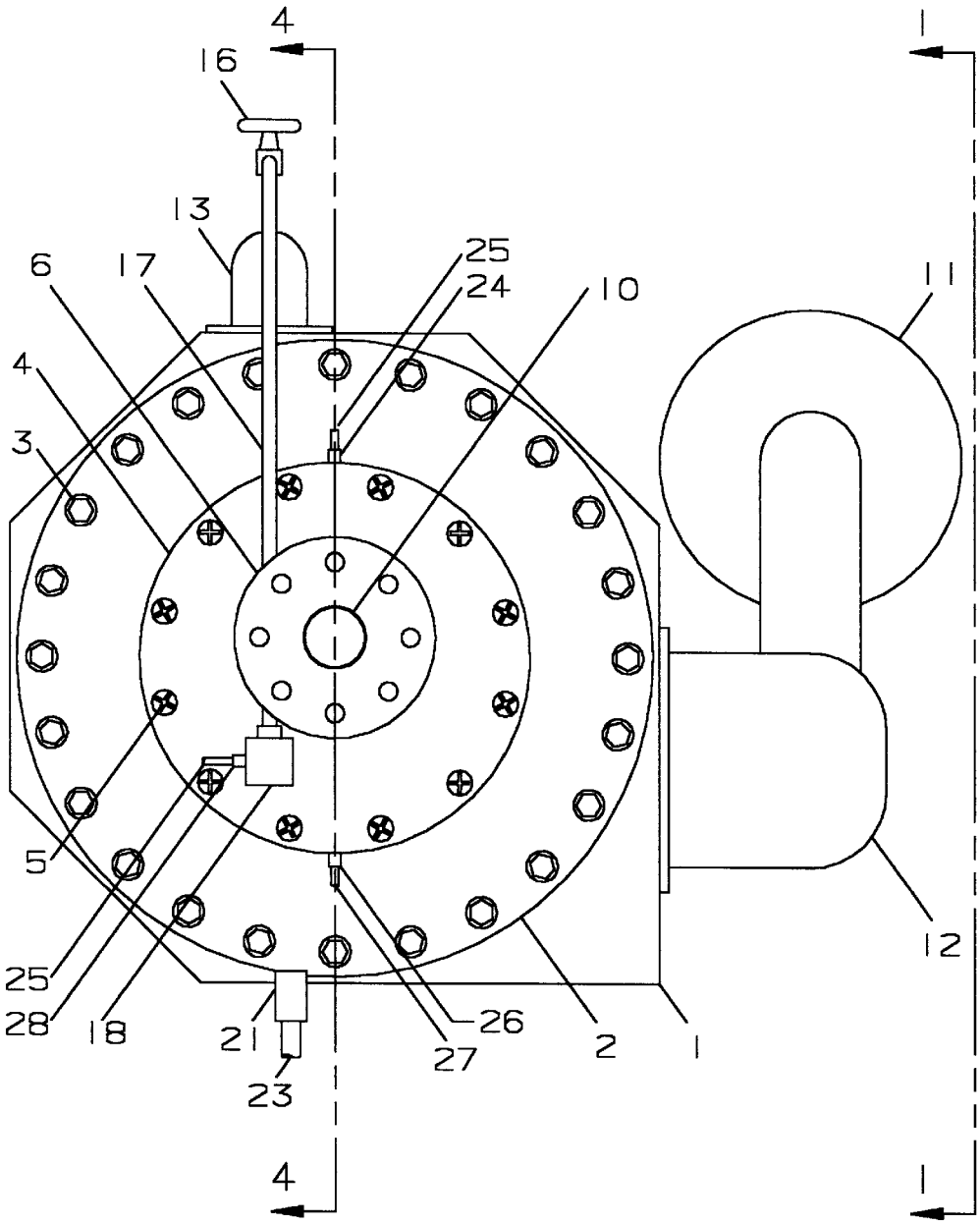
FIG. 2 and FIG. 3 are, respectively, left hand and right hand end views and illustrate the radial disposition of external components.
Figure 3:
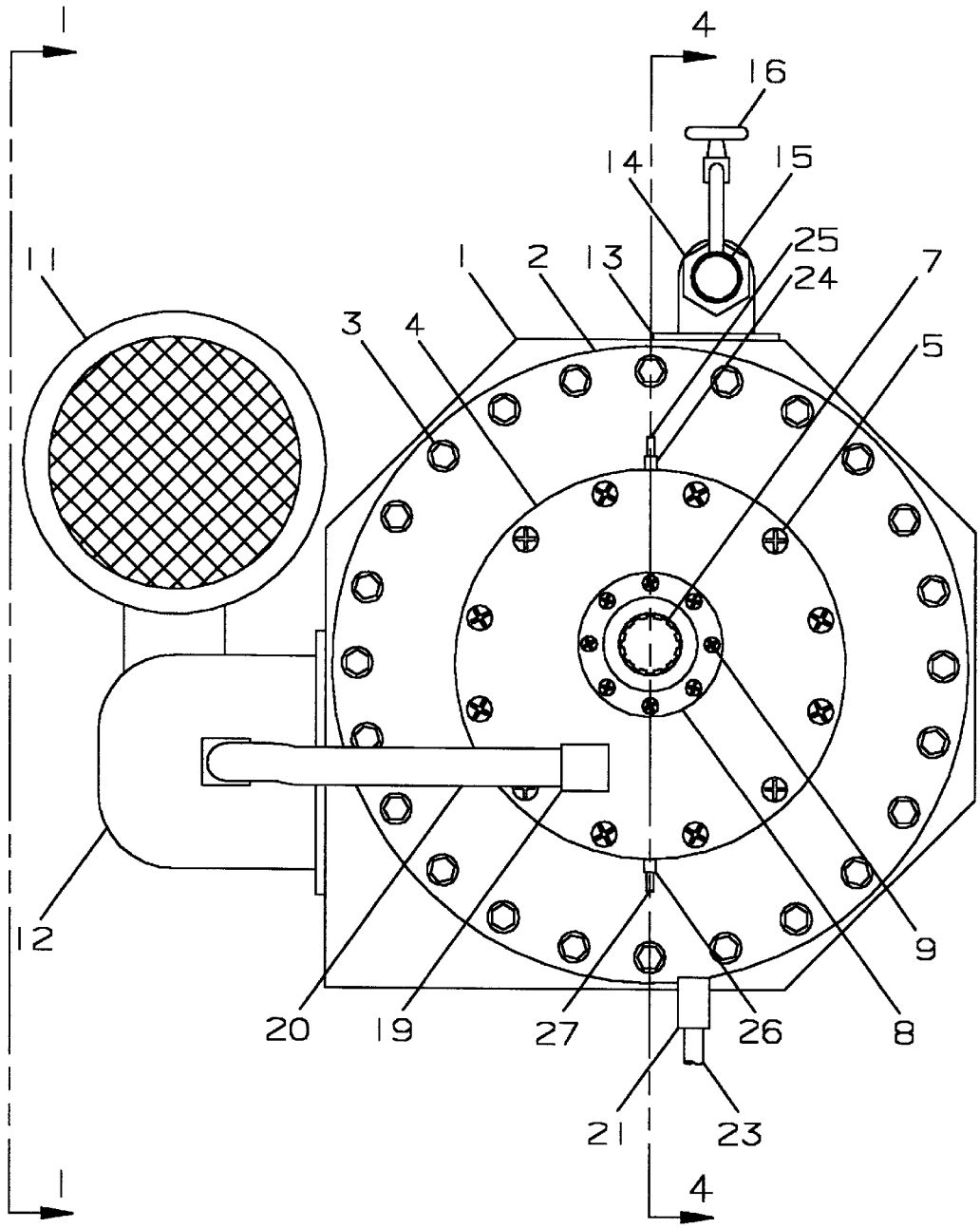

With reference to FIG. 1, FIG. 2, and FIG. 3, stationary containment cylinder 1, combined with an end closure structure 2 installed at each of its axial ends, collectively contain and physically support the dynamic machine components. A tie-bolt 3 installed at each of twenty-four centers mechanically secures each end closure structure 2 to containment cylinder 1. Each end closure structure 2 and its contiguous bearing carrier 4 accommodate and radially secure bearings for rotational components. Machine screw 5 installed at each of twelve equidistantly spaced centers mechanically secures each bearing carrier 4 to its contiguous end closure structure 2. Each bearing retainer 8 axially constrains a rotational bearing for rotational shaft 7. Machine screw 9 installed at each of eight equidistantly spaced centers mechanically secures bearing retainer 8 to contiguous SAID bearing carrier 4. Power input flange 6 interfaces with an external power source to deliver rotational mechanical power to rotational shaft 7. Coupling retainer 10 axially constrains power input flange 6 on rotational shaft 7. Intake filter 11 and induction manifold 12 provide conduit for induction of throughput fluid. Discharge manifold 13 and non-return valve 14 provide conduit for discharge of compressed fluid to external compressed fluid distribution system 15. Control valve 16, manifold 17, and expansion valve 18 provide conduit for supply of compressed throughput fluid for internal thermal control. Pressure relief valve 19 and manifold 20 provide conduit for return of internal thermal control fluid to said induction manifold 12. Orifice valve 21 and manifold 22 provide conduit for condensate to external disposal system 23. Lubricant injector 24 provides conduit for liquid lubricant, or a liquid suspension of dry lubricant, from external lubricant supply system 25 to rotational bearings later discussed. Lubricant extractor 26 provides conduit for excess liquid lubricant from rotational bearings to external liquid lubricant drain system 27. Lubricant injector 28 delivers a supply of finely dispersed liquid lubricant, or a liquid suspension of dry lubricant, to the inducting stream of internal thermal control media for lubrication of internal components.

Figure 4A:
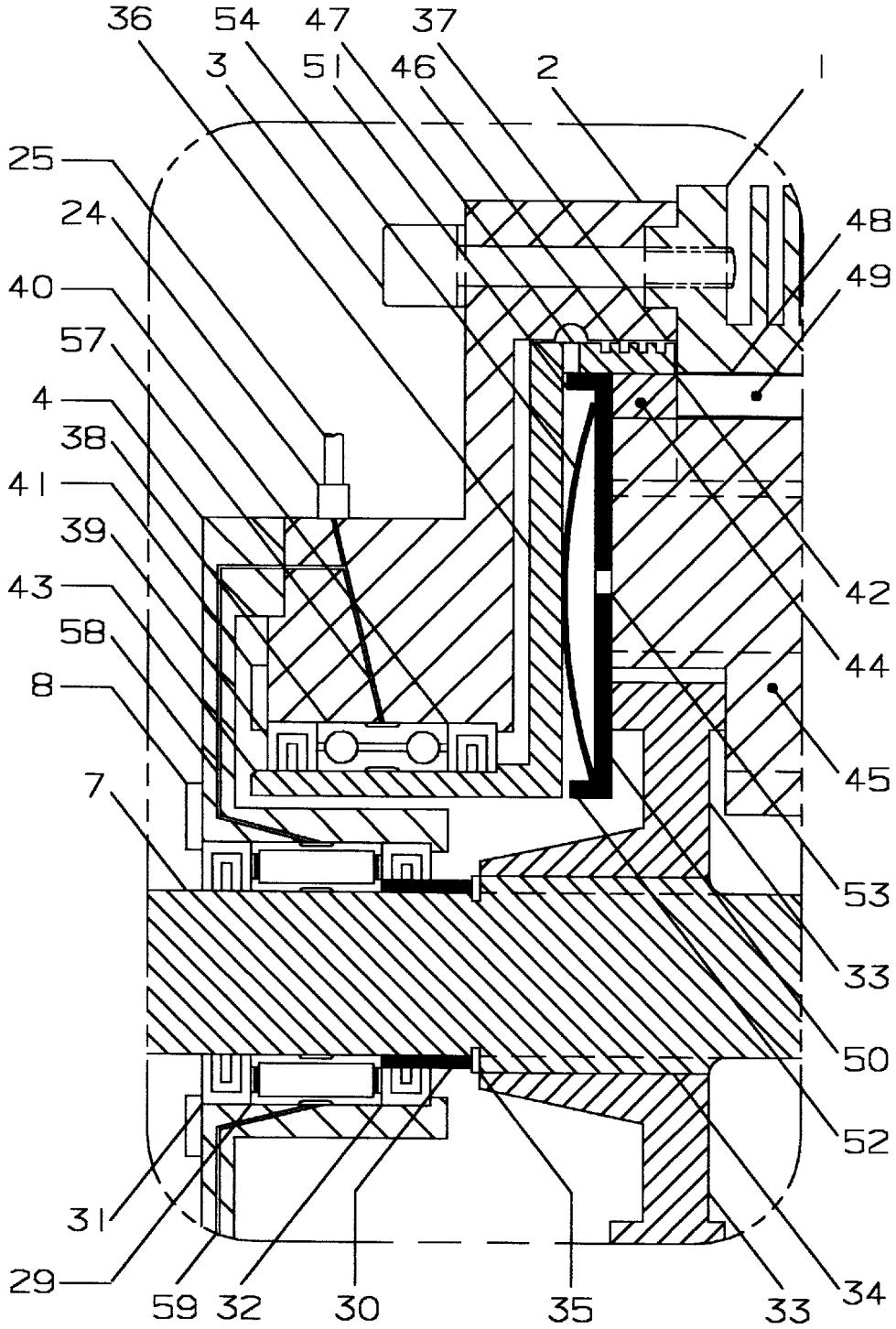
Figure 4B:
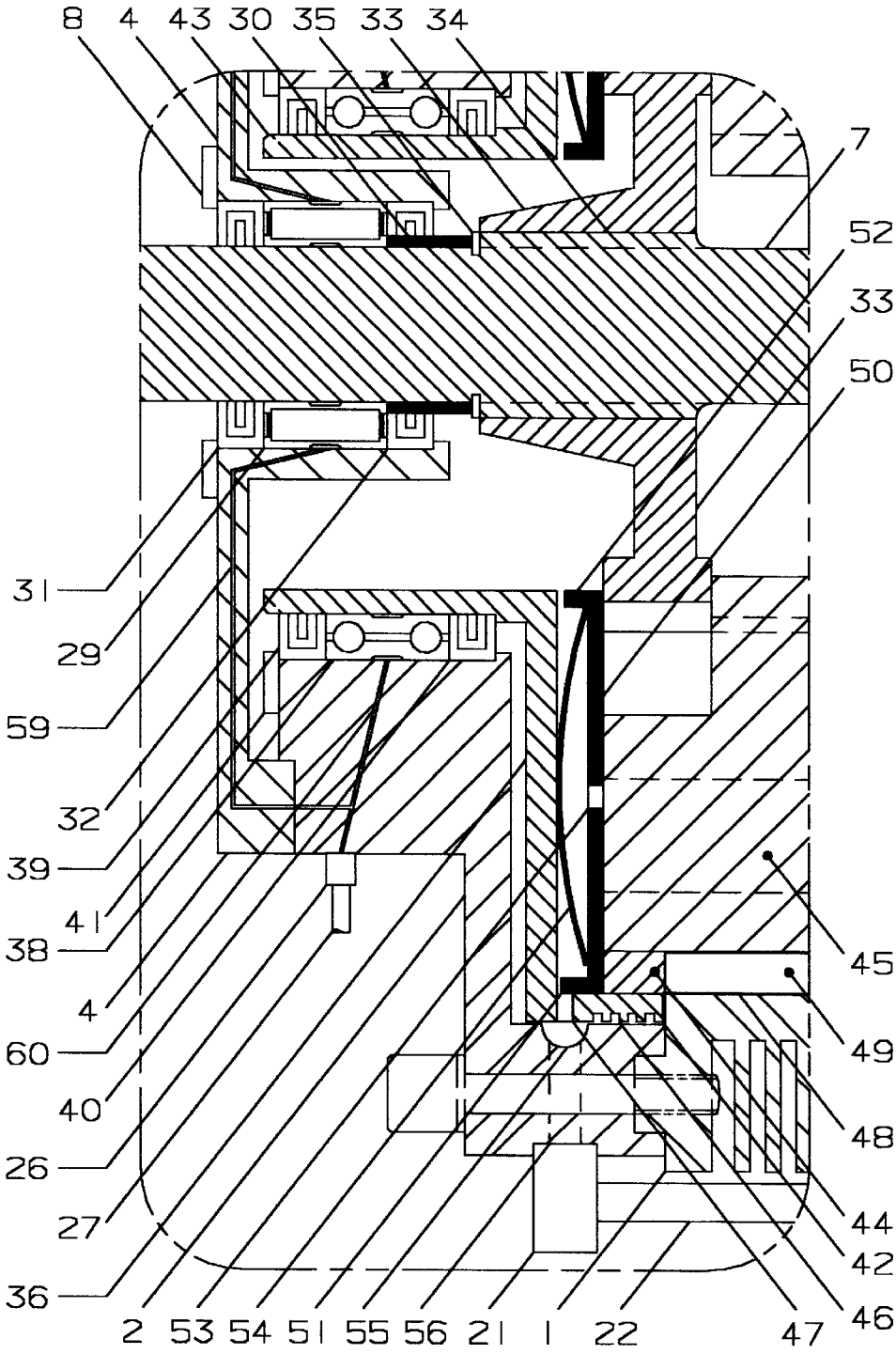

With reference to FIG. 4, FIG. 4A, and FIG. 4B, containment cylinder 1 features a set of closely spaced fins to promote transfer of waste heat to ambient atmospheric air. Rotational shaft 7 extends through the axial length of containment cylinder 1 and through each bearing carrier 4.

Figure 4C:
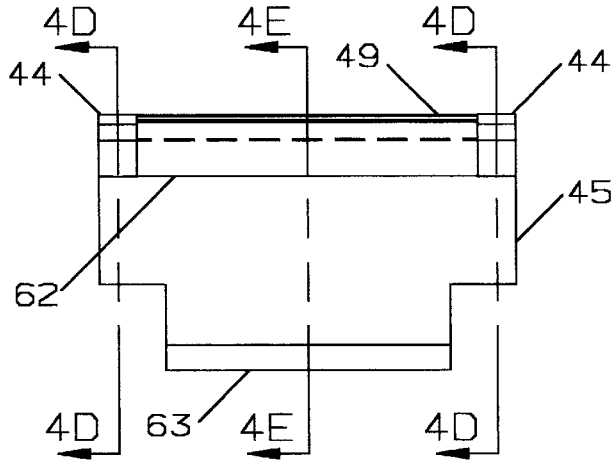
Figure 4D:
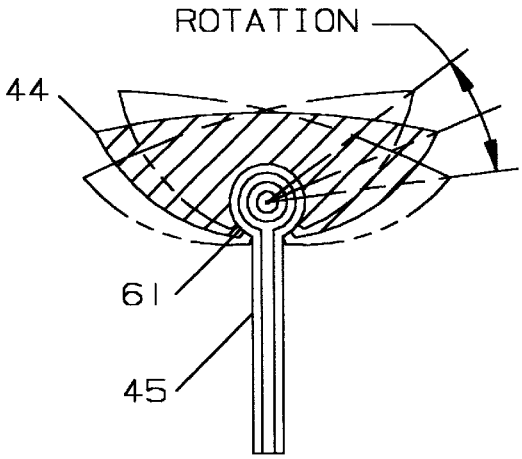
Figure 4E:
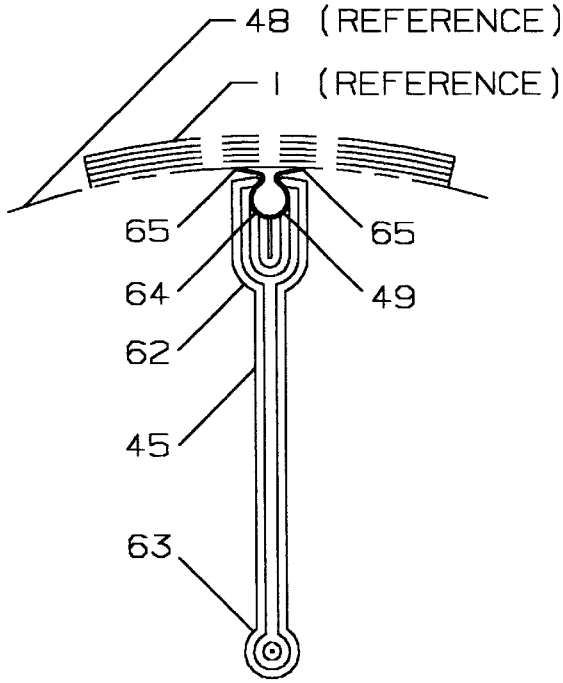

Rotational shaft bearing 29 and rotational shaft sleeve 30 radially and axially constrain rotational shaft 7 at each axial end. Rotational shaft bearing seal 31 precludes contamination of rotational bearing 29 from ambient atmosphere. Rotational shaft bearing seal 32 precludes contamination of rotational bearing 29 from throughput fluid. Rotational shaft bearing 29, rotational shaft bearing seal 31, and rotational shaft bearing seal 32 are collectively accommodated within bearing carrier 4 and axially secured by bearing retainer 8. Rotational armature 33 is concentrically installed on rotational shaft 7 and is rotationally and axially secured at each axial end by spline 34 and spring clip 35. Radial vane constraint ring 36 is diametrically proportioned to make an unconstrained sliding fit with the bore 37 of end closure structure 2 and is radially and axially constrained by radial vane constraint ring bearing 38. Radial vane constraint ring bearing seal 39 precludes reciprocal contamination of radial vane constraint ring bearing 38 and internal thermal control media. Radial vane constraint ring bearing seal 40 precludes reciprocal contamination of radial vane constraint ring bearing 38 and throughput fluid. Radial vane constraint ring bearing 38, bearing seal 39, and bearing seal 40 are collectively accommodated within one end closure structure 2 and axially secured by bearing retainer 41. Each radial vane constraint ring 36 features an axially extended rim flange 42 on its outer periphery and an axially extended flange 43 on its inner periphery. Rim flange 42 protrudes in a direction away from the axially adjacent end closure structure 2. Flange 43 protrudes in a direction toward the axially adjacent end closure structure 2. A circumferential channel 46 is installed at each of four centers equally spaced along the axial length of rim flange 42 to create a dynamic fluid seal with end closure structure bore 37. Port 47 radially extends though rim flange 42 to provide conduit for discharge of condensate. Flange 43 axially extends through and interfaces with radial vane constraint ring bearing 38, bearing seal 39, and bearing seal 40. Rim flange 42 axially extends to enshroud bearing block 44 installed on the axial end of each radial vane 45. Bearing block 44 is proportioned and configured to maintain a small distance of separation between radial vane 45 and stationary containment cylinder bore 48 and to distribute the centripetal force induced by radial vane 45 over an appropriate area of rim flange 42. Radial vane edge seal 49 resiliently closes the distance of separation between radial vane 45 and stationary containment cylinder bore 48. The outer diameter of each axial seal ring 50 is proportioned to make an unconstrained sliding fit with the inner surface of rim flange 42. The radial width of each axial seal ring 50 is proportioned to close the axial end of each radial vane slot later discussed. Each axial seal ring 50 features an axially extended flange 51 on its outer periphery and an axially extended flange 52 on its inner periphery. Flange 51 and flange 52 protrude toward the axially adjacent radial vane constraint ring 36. Axial port 53 provides conduit for discharge of condensate. Axial seal ring 50 is preferably constructed from graphite or other wear resistant self-lubricating structural material. Annular axial compression spring 54 is installed on the axial face of axial seal ring 50 between its outer peripheral flange 51 and its inner peripheral flange 52. The spring rate of annular axial spring 54 is proportioned to induce axial seal ring 50 to maintain resilient contact with the axial end of rotational armature 33 and axially constrain each radial vane 45. The axial extension of annular axial spring 54 is proportioned to accommodate changes in the axial length of containment cylinder 1 and rotational components resulting from thermal and/or mechanical loading. Peripheral drain channel 55 and port 56 combined with axial port 53, radial port 47 provide conduit for condensate to orifice valve 21. Port 57 and port 58 are each a drilled conduit for supply of liquid lubricant, or liquid suspended dry lubricant, to bearing 38 and bearing 29 respectively. Port 59 and port 60 are each a drilled conduit for discharge of excess liquid lubricant, or liquid suspended dry lubricant, from bearing 29 and bearing 38 respectively. Lubricant extractor 26 and lubrication drain 27 remove excess liquid lubricant, or liquid suspended dry lubricant from within the machine assembly for transfer to an external lubrication filtering and distribution system. With reference to FIG. 4C, FIG. 4D, and FIG. 4E, bearing block 44 is installed on radial vane 45 by means of a closely fitted, axially aligned, rotational bearing interface 61 configured and proportioned to allow partial relative rotation. Each radial vane 45 features a material concentration 62 placed on its radially outermost edge to accommodate a radial vane edge seal 49 and material concentration 63 on its radially innermost edge to enhance structural stability and thermal control. Radial vane edge seal 49 is a relatively thin mechanical spring structure configured to engage the radial vane 45 by means of an axially aligned closely fitted rotational bearing interface 64 proportioned to allow partial relative rotation. Radial vane edge seal 49 is axially bifurcated on its outer peripheral edge and the axial bifurcation is configured and proportioned to maintain resilient sliding contact between each bifurcated edge 65 and the bore 48 of containment cylinder 1.

Figure 5A:
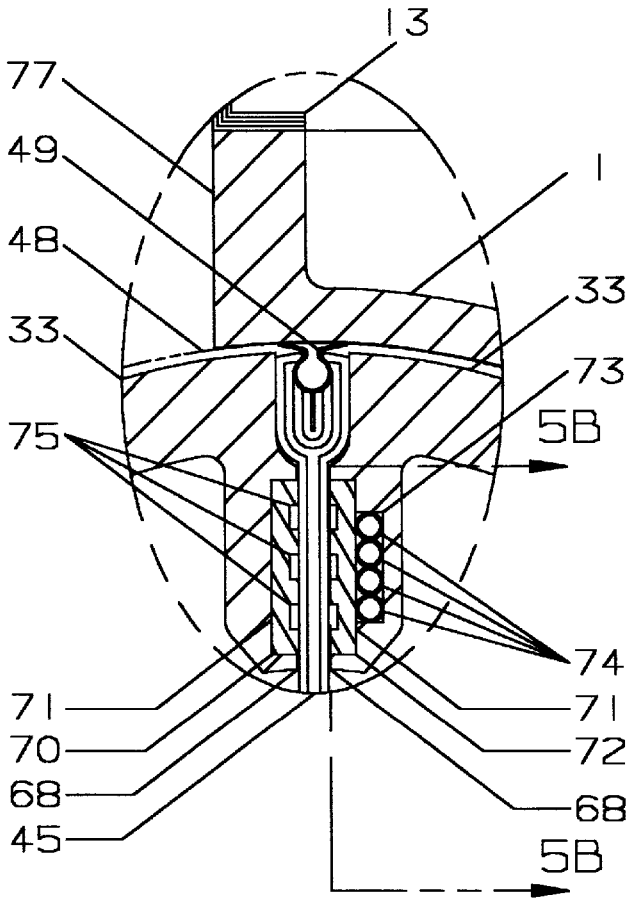
Figure 5B:
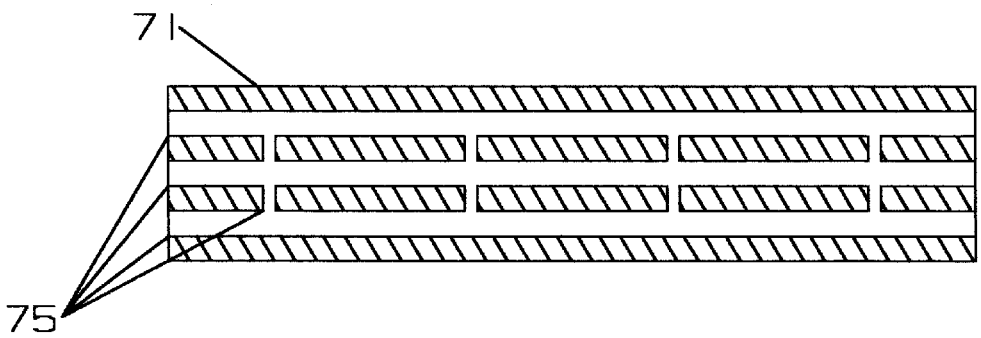

With reference to FIG. 5, FIG. 5A, and FIG. 5B, containment cylinder bore 48 is circular in cross section and may be surface treated to enhance corrosion resistance, wear resistance, and/or self-lubricating properties. Rotational armature 33 features a circular cross section diametrically proportioned to approximately ninety percent of the diameter of containment cylinder bore 48. Rotational axis 66 of rotational shaft 7 is parallel to axis 67 of containment cylinder bore 48 but radially separated by distance "X". Rotational armature 33 is configured as a structural annulus and accommodates an axially aligned radial vane slot 68 at each of twelve centers equidistantly spaced around its outer periphery. Radial vane slot 68 is proportioned to axially extend through the axial length of rotational armature 33 and radially extend through its wall thickness. To increase the internal surface area exposed to internal thermal control media, rotational armature 33 accommodates a surface area augmentation slot 69 at each of twelve radian centers, equidistantly interspersed between radial vane slots, on its inner periphery. Each surface area augmentation slot 69 is proportioned to axially extend through the axial length of the annulus portion of rotational armature 33 and radially extend partially through its wall thickness. The side of each radial vane slot 68 opposed to the direction of rotation is configured with an axial channel 70 radially proportioned to accommodate and secure one linear bearing insert 71. The side of each radial vane slot 68 in the direction of rotation is configured with an axial channel 72 radially proportioned to accommodate one linear bearing insert 71 with a closely constrained but sliding fit and accommodate axial channel 73. Axial channel 73 is radially proportioned to accommodate an axially aligned tubular radial compression spring 74 at each of four equidistantly spaced centers along the radial width of linear bearing insert 71. Each tubular radial compression spring 74 is proportioned to provide a spring rate sufficient to maintain resilient bearing contact between linear bearing insert 71 and its contiguous radial vane 45 and radial extension sufficient to accommodate dimensional changes in its associated interfacing components resulting from thermal loading, mechanical loading and wear. The sliding face of each linear bearing insert 71 accommodates a groove pattern 75 to preclude or minimize hydrodynamics adhesion of linear bearing insert 71 to its contiguous radial vane 45. Linear bearing insert 71 is preferably constructed from graphite or other wear resistant, low friction material. Port 76 and port 77 penetrate the wall of containment cylinder 1 to provide conduit for induction and discharge of throughput fluid respectively.

With reference to FIG. 6, each linear bearing insert 71 and each radial compression spring 74 extends through the axial length of rotational armature 33. Radial vent channel 78 installed at each of two centers equidistantly spaced along the inner axial length of axial channel 72 provides conduit to the internal cavity of rotational armature 33 to preclude occurrence of hydraulic lock on linear bearing insert 71. Arrangements of all other components were discussed in prior paragraphs.

Figure 7A:
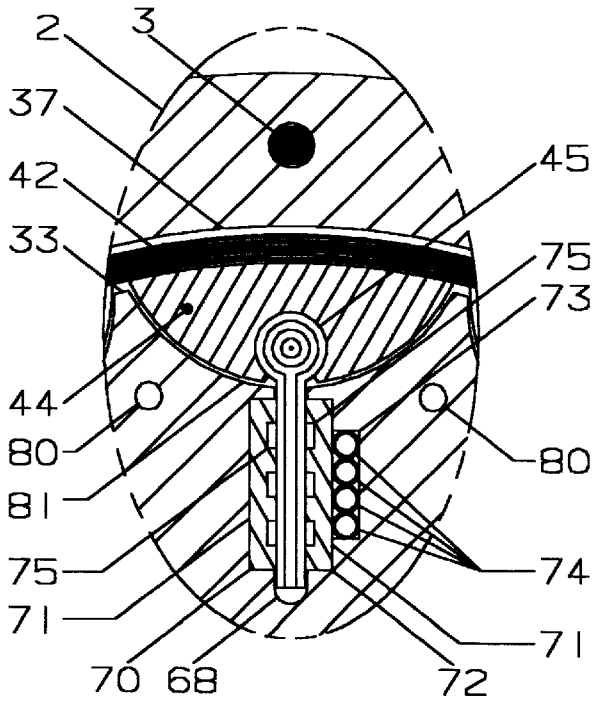

With reference to FIG. 7 and FIG. 7A, rotational armature 33 is coaxially secured to rotational shaft 7 by mechanical spline 34. Port 79 extends through the axial end of rotational armature 33 to provide conduit for movement of internal thermal control media. Port 80 extends through the axial end of rotational armature 33 to provide conduit for discharge of condensate. Radial vane constraint ring rim flange 42 is diametrically proportioned to maintain an unconstrained sliding fit with bore the 37 of end closure structure 2. One bearing block 44 is secured to each radial vane 45 and is proportioned to maintain an appropriate area of contact with the inside surface of rim flange 42. Each axial end of each rotational vane slot 68 incorporates a scalloped recess 81 proportioned to accommodate bearing block 44 at all rotational positions of rotational armature 33. Arrangements of other illustrated components were discussed in prior paragraphs.

With reference to FIG. 8, the outer diameter of the outer peripheral flange 51 of axial seal ring 50 is proportioned to maintain a closely constrained but sliding fit with the inner surface of radial vane constraint ring rim flange 42. Axial port 53 installed on each of eighteen radian centers equally spaced around the axial seal ring 50 provides conduit for condensate discharge. Arrangements of other illustrated components were discussed in prior paragraphs.

With reference to FIG. 9 FIG. 9A, and FIG. 9B, annular axial compression spring 54 is a quasi-flat ring with an inner diameter proportioned to maintain a constrained but sliding fit with axial seal ring axially extended flange 52. The outer diameter of annular axial compression spring 54 is proportioned to maintain a small distance of separation with the inside surface of axial seal ring peripheral flange 51. Annular axial spring 54 features a semi-independent radial spring segment 82 installed at each of twenty-four equidistantly spaced radial centers with each spring segment 82 integrally secured on a common root 83. In the axial plane each segment 82 is configured as a single arc. Material thickness and axial shaping of annular axial compression spring 54 are proportioned to fulfill spring rate and axial extension requirements as specifically appropriate for intended service. For the purpose of this disclosure annular axial compression spring 54 is illustrated as a single entity however an assembly consisting of a multiplicity of annular axial compression spring entities may be selected as necessary to fulfill particular service requirements. Arrangements of other illustrated components were discussed in prior paragraphs.

With reference to FIG. 10, rotational vane constraint ring bearing 38 is installed in and radially constrained by end closure structure 2 and radially constrains radial vane constraint ring flange 43. Rotational shaft sleeve 30 is concentrically secured on rotational shaft 7.

With reference to FIG. 11, rotational shaft bearing 29 is installed in and radially constrained on its outer periphery by bearing carrier 4 and radially constrains rotational shaft 7. Machine screw 5 installed at each of twelve equidistantly spaced centers secures bearing carrier 4 to stationary containment structure. Port 84 provides conduit for induction or discharge internal thermal control media.

With reference to FIG. 12 and FIG. 13, one throughput fluid induction port 76 is installed at each of four centers equidistantly spaced along the axial length of stationary containment cylinder 1. Each throughput fluid induction port 76 provides conduit for the movement of throughput fluid from intake manifold 12 through the wall of stationary containment cylinder 1. Channel 55 installed in the bore 37 of each end closure structure 2 provides conduit for discharge of condensate from the machine interior. Arrangements of end closure structures 2 and bearing carriers 4 were discussed in prior paragraphs.

With reference to FIG. 14 and FIG. 15, one throughput fluid discharge port 77 is installed at each of four centers equidistantly spaced along the axial length of stationary containment cylinder 1. Each throughput fluid discharge port 77 provides conduit for the movement of compressed throughput fluid through the wall of stationary containment cylinder 1 to discharge manifold 13. Arrangements of other illustrated components were discussed in prior paragraphs.

I claim as my invention:

1. A rotary vane machine for industrial scale pressure amplification of gaseous and/or vaporous fluids and comprising:

a stationary containment cylinder with circular bore and installed with radially projecting throughput fluid induction and throughput fluid discharge ports within its axial length;

an end closure structure mechanically secured at each axial end of aforesaid containment cylinder with each said end closure structure installed with a rotational bearing coaxially aligned with the bore axis of aforesaid containment cylinder, with bearing lubricant supply and discharge ports, and with a condensate discharge port;

a bearing carrier mechanically secured at each outermost axial end of aforesaid end closure structure with each said bearing carrier installed with a rotational bearing aligned to be parallel with but radially displaced from the bore axis of aforesaid containment cylinder, with bearing lubricant supply and discharge ports, and with an internal thermal control and lubrication media port;

a rotational shaft installed within aforesaid containment cylinder proportioned to axially extend through, and be radially and axially constrained by aforesaid rotational bearings installed in aforesaid bearing carriers and with one or both ends configured to interface with an external rotational power source;

a rotational armature concentrically secured on aforesaid rotational shaft within aforesaid containment cylinder, consisting of a structural annulus with an integral closure disk at each axial end and with each said closure disk featuring axially aligned thermal control and lubrication media ports and axially aligned condensate discharge ports;

a surface area augmentation slot installed at each of twelve centers uniformly distributed around the inner periphery of aforesaid structural annulus with each said area augmentation slot proportioned to extend through the axial length and partially through the radial thickness of aforesaid structural annulus;

a radial vane slot installed on each of twelve centers uniformly distributed around the circumference of aforesaid rotational armature with each said radial vane slot equally distanced from each adjacent aforesaid area augmentation slot, with each said radial vane slot proportioned to extend through the axial length of said rotational armature, extend through the radial thickness of said structural annulus, and accommodate one radial vane;

a radial vane installed in each aforesaid radial vane slot and proportioned to extend through the axial length of aforesaid rotational armature and radially extend through the radial thickness of the structural annulus of aforesaid rotational armature;

a radial vane support linear bearing segment slot installed in each face of each aforesaid radial vane slot with each said radial vane support linear bearing segment slot proportioned to extend through the axial length of aforesaid rotational armature and partially through the radial depth of aforesaid radial vane slot;

a radial vane support linear bearing segment installed in each aforesaid radial vane support linear bearing segment slot with each said radial vane support linear bearing segment proportioned to extend through the axial length of aforesaid rotational armature and be constrained by the aforesaid radial vane support linear bearing segment slot and the surface of the adjacent aforesaid radial vane;

a radial compression spring slot installed in one face of each aforesaid radial vane support linear bearing segment slot with each said radial compression spring slot proportioned to extend through the axial length of aforesaid rotational armature and partially through the radial depth of aforesaid radial vane support linear bearing segment slot;

a radial compression spring assembly installed in one face of each aforesaid radial vane slot and with each said radial compression spring assembly axially proportioned to extend through the axial length of aforesaid rotational armature and radially proportioned to maintain resilient pressure contact of one aforesaid radial vane support linear bearing segment with the adjacent aforesaid radial vane;

a radial vane edge seal individually installed on the radially outermost axial edge of each aforesaid radial vane with said radial vane edge seal configured to feature an axial bifurcation on its outermost axial edge, axially proportioned to extend through the axial length of aforesaid radial vane, and radially proportioned to maintain resilient contact with the bore of aforesaid containment cylinder;

a radial vane constraint ring installed at each axial end of aforesaid rotational armature with each said radial vane constraint ring featuring a circular cross-section with its outer diameter proportioned to closely approach the bore of aforesaid end closure structure and its inner diameter proportioned to permit unconstrained axial passage of aforesaid rotational shaft;

a circumferentially continuous flange integrally installed on the outer periphery of each aforesaid radial vane constraint ring with said circumferentially continuous flange diametrically and axially proportioned to enshroud the axial ends of aforesaid radial vanes and with said circumferentially continuous flange fitted with radially oriented condensate discharge ports;

a circumferentially continuous flange integrally installed on the inner periphery of each aforesaid radial vane constraint ring with said circumferentially continuous flange axially proportioned to extend through and be radially and axially constrained by aforesaid rotational bearings installed in the adjacent aforesaid end closure structure;

a bearing block individually secured on each axial end of the radially outermost axial edge of each aforesaid radial vane with each said bearing block proportioned to maintain an area of bearing contact with the inner surface of the aforesaid circumferentially continuous flange on the outer periphery of aforesaid radial vane constraint ring;

an axial seal ring installed at each axial end of aforesaid rotational armature with each said axial seal ring circular in cross-section, its outer diameter proportioned to make a constrained but sliding fit within the inner surface of aforesaid continuous flange on the outer periphery of aforesaid radial vane constraint ring, with its radial face width proportioned to close the axial ends of aforesaid radial vane slots, and with condensate discharge ports installed on its axial face;

a circumferentially continuous channel coaxially installed on one axial face of each aforesaid axial seal ring with said circumferentially continuous channel oriented to face the adjacent aforesaid radial vane constraint ring and proportioned to accommodate an axial compression spring;

an axial compression spring axially installed within each aforesaid circumferentially continuous channel radial in each aforesaid axial seal ring and with each said axial compression spring proportioned to maintain resilient axial pressure contact of aforesaid axial seal ring with the axial end of aforesaid rotating armature.

* * * * *